United States Patent [19]

Rys

[11] 4,090,157

[45] May 16, 1978

[54] OPERATING HANDLE MEANS FOR STACKED CIRCUIT BREAKER MODULES

[75] Inventor: Tadeusz J. Rys, Bellefontaine, Ohio

[73] Assignee: Gould Inc., Rolling Meadows, Ill.

[21] Appl. No.: 763,888

[22] Filed: Jan. 31, 1977

[51] Int. Cl.[2] ..... H01H 73/02

[52] U.S. Cl. ..... 335/8; 337/47

[58] Field of Search ..... 335/8, 9, 10; 337/45, 337/46, 47, 48, 49, 50

[56] References Cited

U.S. PATENT DOCUMENTS

| | | | |
|---|---|---|---|
| 2,678,359 | 5/1954 | Brumfield | 335/8 |
| 2,824,191 | 2/1958 | Christensen | 337/50 |
| 2,913,542 | 11/1959 | Myers | 335/10 |
| 3,530,412 | 9/1970 | Gryctko | 335/8 |

*Primary Examiner*—Harold Broome

*Attorney, Agent, or Firm*—Ostrolenk, Faber, Gerb & Soffen

[57] ABSTRACT

Single pole circuit breaker modules having identical current carrying elements as well as identical fault responsive trip means and spring powered contact operating mechanism, are stacked side-by-side. A transverse tie rod extends through the housings of all modules to interconnect all operating mechanisms for simultaneous operation at points where the operating members of the operating mechanisms are capped by insulating members. Only one of the modules is provided with a manual operating member.

10 Claims, 10 Drawing Figures

OPERATING HANDLE MEANS FOR STACKED CIRCUIT BREAKER MODULES

This invention relates to multipole circuit interrupters constructed by stacking single pole modules, and more particularly relates to means for mechanically tying the operating members of these modules together for operation in unison.

My co-pending application Ser. No. 703,078, filed July 6, 1976, describes the construction of single pole circuit breaker modules for moderately high current rating, say 150 amps. at 600 volts with an interrupting capacity of greater than 10,000 amps. The circuit breaker of the aforesaid co-pending application Ser. No. 703,078 is of particularly compact construction especially insofar as housing width is concerned. This latter feature could present arcing clearance problems when the modules are stacked side-by-side and mechanically interconnected to form a multipole circuit interrupter, especially when a tie rod internal to the interrupter housing is utilized to connect the contact operating mechanism of all modules.

In order to overcome this difficulty, the instant invention constructs each module with a spring powered contact operating mechanism including an operating member disposed entirely within the circuit breaker housing and having a narrow front portion disposed midway between the housing walls and extending into a recess in an insulating cap also disposed within the housing. An insulating tie rod extends through aligned apertures in the operating members and caps of all modules. The cap of only one module is provided with a manually engageable handle disposed outside of the housing. For the other modules the handle openings are closed by an insulating cover.

Accordingly, a primary object of the instant invention is to provide a novel construction for a multipole circuit interrupter constructed of stacked single pole modules.

Another object is to provide a circuit interrupter of this type having novel means for mechanically interconnecting the contact operating mechanisms of all modules.

Still another object is to provide a circuit interrupter of this type in which the modules are relatively narrow in relation to the rating of the circuit interrupter.

A further object is to provide a circuit interrupter of this type in which only one of the modules is provided with a manual operating handle.

These objects as well as other objects of this invention shall readily become apparent after reading the following description of the accompanying drawings in which:

FIG. 1 is a side elevation of the center circuit breaker module of the three pole circuit breaker of FIG. 7 constructed in accordance with teachings of the instant invention, looking in the direction of arrows 1—1 of FIG. 7, with the near housing half removed so as to reveal the internal elements.

FIG. 2*a* is a fragmentary plan view in the vicinity of line 2*a*, 2*a* of FIG. 1 looking in the direction of arrows 2*a*, 2*a* to illustrate the line terminal number disposed within the housing.

FIG. 2*b* is a plan view through line 2*b*, 2*b* of FIG. 1 looking in the direction of arrows 2*b*, 2*b* to illustrate the position of the contact operating elements in the housing.

FIG. 2*c* is a cross-section taken through line 2*c*, 2*c* of FIG. 1 looking in the direction of arrows 2*c*, 2*c*.

Figure 1:
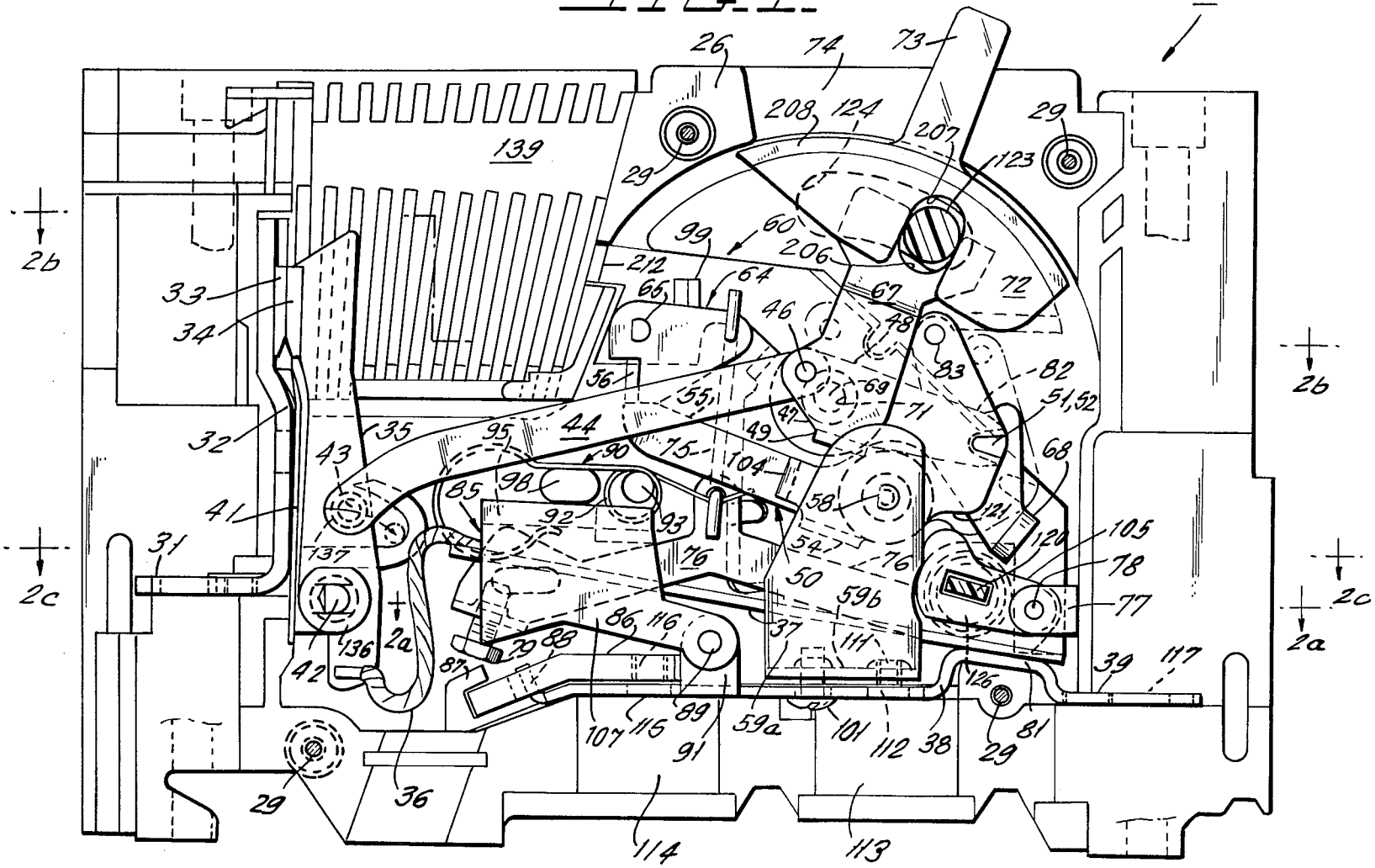

Now referring to the Figures. Circuit breaker pole unit or module 25 of FIG. 1 is the center pole of three pole circuit interrupter 200 of FIG. 7. Module 25 includes a narrow molded insulating housing consisting of sections 26, 27 which mate at line 28 (FIG. 2*b*) and are secured together by rivets 29. The current carrying path through module 25 extends from load terminal 31, to which a wire grip (not shown) may be mounted, stationary contact 33 at the end of load terminal strap 32 remote from load terminal 31, movable contact 34 at one end of movable contact arm 35, through contact arm 35 and braid 36 connected to the other end of arm 35, through bimetal 37 to line terminal member 38 whose right end 39 is positioned for mounting of a wire grip (not shown).

Thin insulating sheet 41 is interposed between movable contact arm 35 and load terminal strap 32 to electrically insulate these elements for a major portion of the length of contact arm 35. However, these elements are so close to one another that current limiting through contact blow-off is achieved by interaction of magnetic fields which accompany current flow in strap 32 and arm 35.

Figures 2A, 2B, 2C:
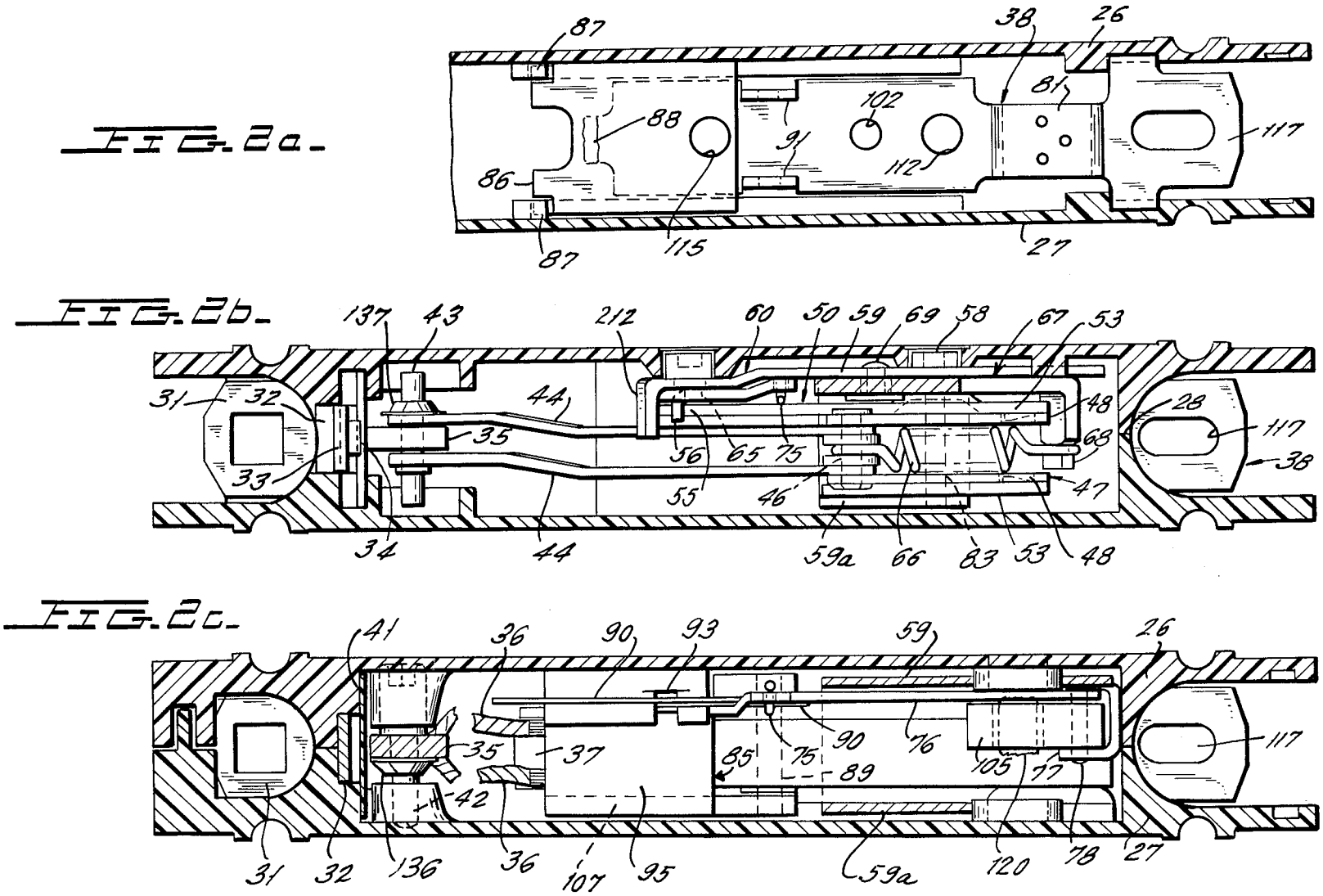

The lower end of contact arm 35 is pivotally mounted on a fixed pivot provided by pin 42 whose ends extend into recesses in both housing portions 26 and 27. Pin 43, located at a point between movable contact 34 and pin 42, connects contact arm 35 to one end of toggle link 44 having its other end connected by pin 46 to the other toggle member 47. Operative securement of pins 42, 43 is provided by the respective push nuts 136, 137. Link 44 consists of two identical parallel arms spaced by the thickness of contact arm 35 (FIG. 2*b*). Toggle line 47 is a bifurcated element having parallel sections 48, 48 joined by web 49. Sections 48, 48 are each provided with a V-notch 51 which receives a boss 52 on the inner surface of parallel walls 53, 53 of cradle 50 which are joined by web 54. One wall 53 is provided with a bent over portion 104 that extends to the other wall 53, and the latter is provided with latching tip extension 53 engageable by latching protrusion 56. Portion 104 is engageable with link 47 to act as a kicker for separation of contacts 33, 34 should they tend to weld or otherwise stick closed.

Aligned apertures in walls 53, 53 receive pin 58 which pivotally mounts cradle 50 to formed mounting plate or frame 60 at aligned apertures in spaced parallel main and auxiliary walls 59, 59*a* of plate 60. Web section 59*b* connects walls 59, 59*a* in spaced parallel relationship. Screw 101 (FIG. 1) extends through clearance aperture 102 (FIG. 2a) in terminal member 38 and is received by a threaded aperture in web 59b to secure mounting plate 60 to member 38. Cantilevered latching protrusion 56 extends perpendicular to the main planar portion of latch member 64 and is formed integrally therewith. Member 64 is mounted on plate 60 by cantilevered pivot pin 65.

Figure 5:
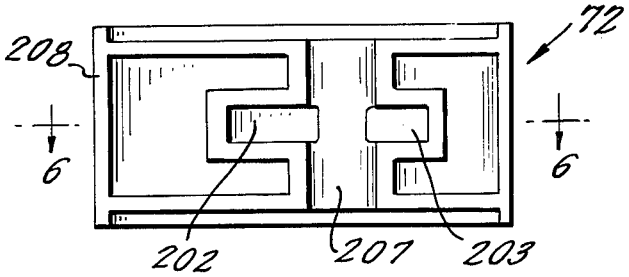
FIG. 5 is a rear view of the cap-handle member looking in the direction of arrows 5—5 of FIG. 3.
Figure 6:
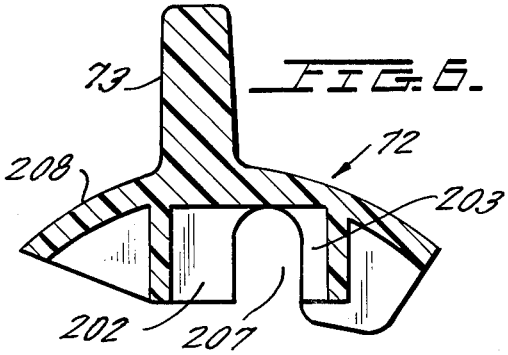
FIG. 6 is a cross-section of the cap-handle member taken through line 6—6 of FIG. 5 looking in the direction of arrows 6—6.
Figure 8:
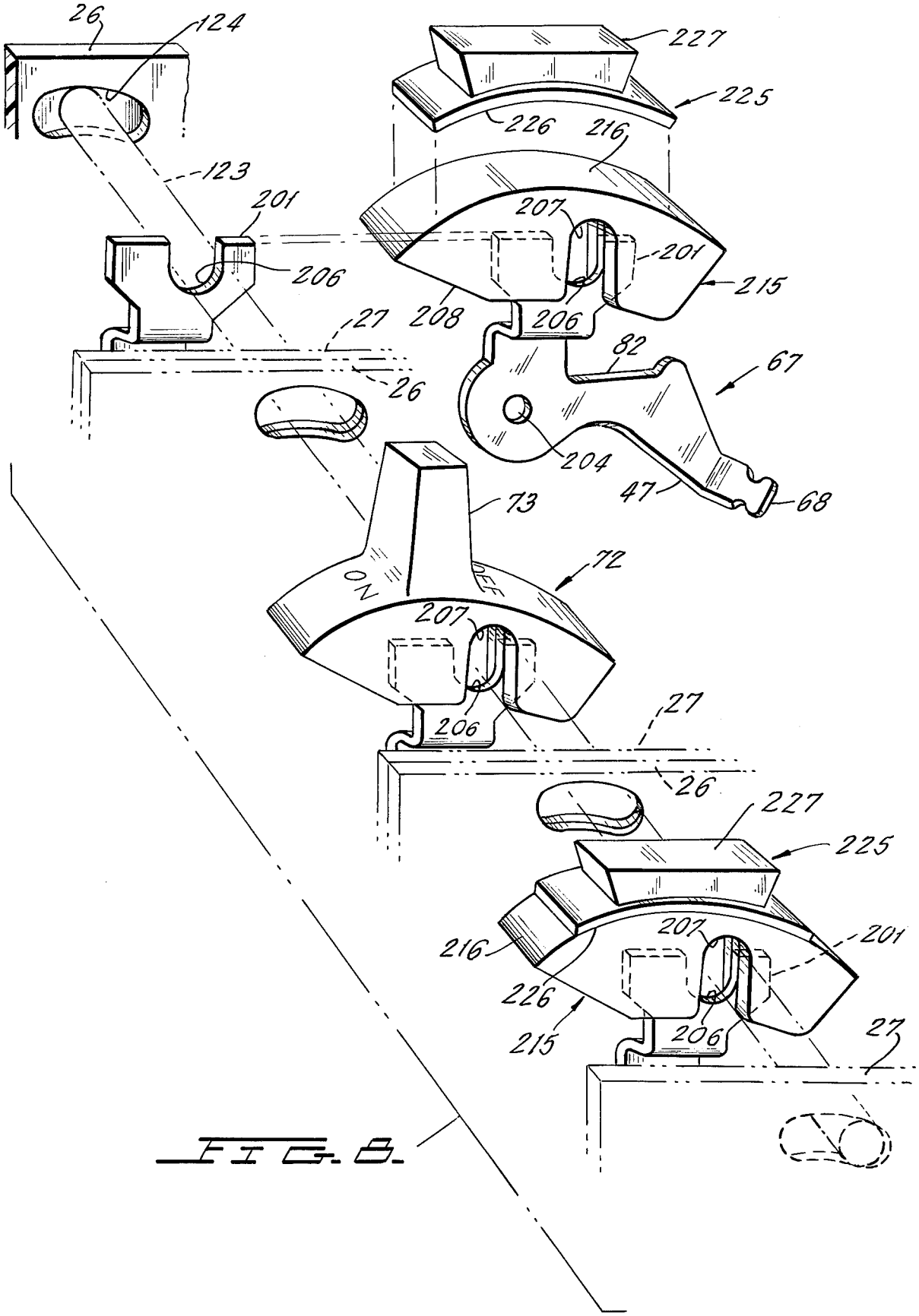
FIG. 8 is an exploded perspective showing those elements which mechanically tie together the operating members for the three modules constituting the circuit interrupter of FIG. 7.

Main operating spring 66 (FIG. 2b) is a coiled tensioned member connected at one of its ends to toggle knee pin 46 and at the other of its ends to operating member 67 at projection 68 thereof. Member 67 is mounted to pivot pin 69 that extends through aperture 204 in member 67 and aperture 71 in main wall 59 of mounting member 60 to center the bifurcated front end 201 of member 67 between housing parts 26, 27. The sections of front end 201 of operating member 67 extend into complementary recess sections 202, 203 (FIG. 5) in the rear surface of cap-handle member 72. The latter includes extension or handle 73 which projects forward from cap portion 208 of member 72 through aperture 74 in the front edge of housing 26, 27 so that handle 73 is accessible for manual operation of module 25.

Formed wire link 75 connects latch member 64 to trip member 76 at a point intermediate the ends of the latter. Member 76 is pivotally mounted at one of its ends to mounting member ear 77 by pin 78 which also pivotally mounts plastic interpole trip lever 105 (FIG. 2c). Lever 105 and member 76 are disposed side-by-side between ear 77 and wall 59. Adjustment screw 79 is threadably mounted to end of trip member 76 remote from pin 78. As seen in FIG. 1, the right end of the bimetal 37 is fixedly secured to inclined offset 81 of line terminal member 38 and the free end of bimetal 37 is aligned with screw 79. Upon heating of bimetal 37 due to abnormal current conditions existing for an extended period of time, the free end of bimetal 37 deflects rearward and engages screw 79 to pivot trip member 76 counterclockwise with respect to FIG. 1. This moves link 75 downward to pivot latch member 64 clockwise whereby latch 56 releases cradle tip 55. Now, under the influence of main operating spring 66 cradle 50 pivots clockwise and moves the right end of toggle 44, 47 below the line of action of spring 66 so that the latter is effective to move toggle link 46 rapidly to the right with respect to FIG. 1 causing contact arm 35 to pivot clockwise and separate movable contact 34 from stationary contact 33.

To reset cradle 50, handle 73 is moved to the left with respect to FIG. 1 with resetting surface 82 of operating member 67 engaging reset pin 83 mounted on cradle 50 to move the latter counterclockwise until latch tip 55 falls below latch 56. Subsequent movement of handle 73 to the right with respect to FIG. 1 moves the right end of spring 66 downward until its line of action is below the right end of toggle 44, 47 at which point spring 66 moves toggle link 46 downward. This extends toggle 44, 47 thereby moving contact 34 into engagement with contact 33. For manually opening circuit breaker 25 handle 73 is moved to the left with respect to FIG. 1 and in so doing the right end of spring 66 is moved above the right end of toggle 44, 47 so that the line of action of spring 66 is then directed to collapse toggle 44, 47 and separate movable contact 34 from stationary contact 33.

In addition to thermal trip means provided by bimetal 37, circuit breaker 25 also includes magnetic or instantaneous trip means comprising stationary magnetic plate 86 and U-shaped armature 85 having arms 107 between which bimetal 37 extends. The left edge of plate 86 is captured under housing formation 87 and plate 86 is secured to the upwardly extending tab 88 at the left end of line terminal member 38. Pin 89 pivotally mounts armature 85 to upwardly extending ears 91 of line terminal member 38. Dual purpose formed wire spring 90 includes central looped portion 92 that receives housing formation 93. The left end of spring 90 is curved and reversely bent to engage the rear surface of armature web portion 95. The right end of spring 90 is interposed between link 75 and trip member 76 to bear against a step at the rear of link 75. The loading and positioning of spring 90 is such that it biases armature 85 clockwise against housing formation stop 98 and also biases link 75 upward. This biases trip member 75 clockwise about its pivot 78 and biases latch member 64 counterclockwise toward its latching position in engagement with mounting plate stop formation 99.

Mounting plate 60 is constructed of steel sheet and is connected to strap 38 so that line terminal potential appears at ear 212 of mounting plate 60. Ear 212 is positioned at the exit for arc chute 139 adjacent the last deion plate (not shown) thereof to enhance rapid build-up of arc voltage in arc chute 139 upon separation of contacts 33, 34. It is noted that in FIG. 1 only internal housing grooves for positioning the deion plates of arc chute 139 are shown.

Threaded aperture 111 is aligned with clearance aperture 112 in line terminal member 38 to provide means whereby a screw (not shown) may be used to electrically and mechanically secure a line terminal stab (not shown), positioned in housing recess 113, to line terminal member 38. For connecting the line terminal stab at another location along the length of line terminal member 38, the circuit breaker housing is provided with another recess 114 aligned with clearance aperture 115 in strap 83 and threaded aperture 116 in stationary magnetic member 86. The end of line terminal member 38 remote from magnetic member 86 is provided with elongated aperture 117 for connection of a wire grip device (not shown).

Figure 7:
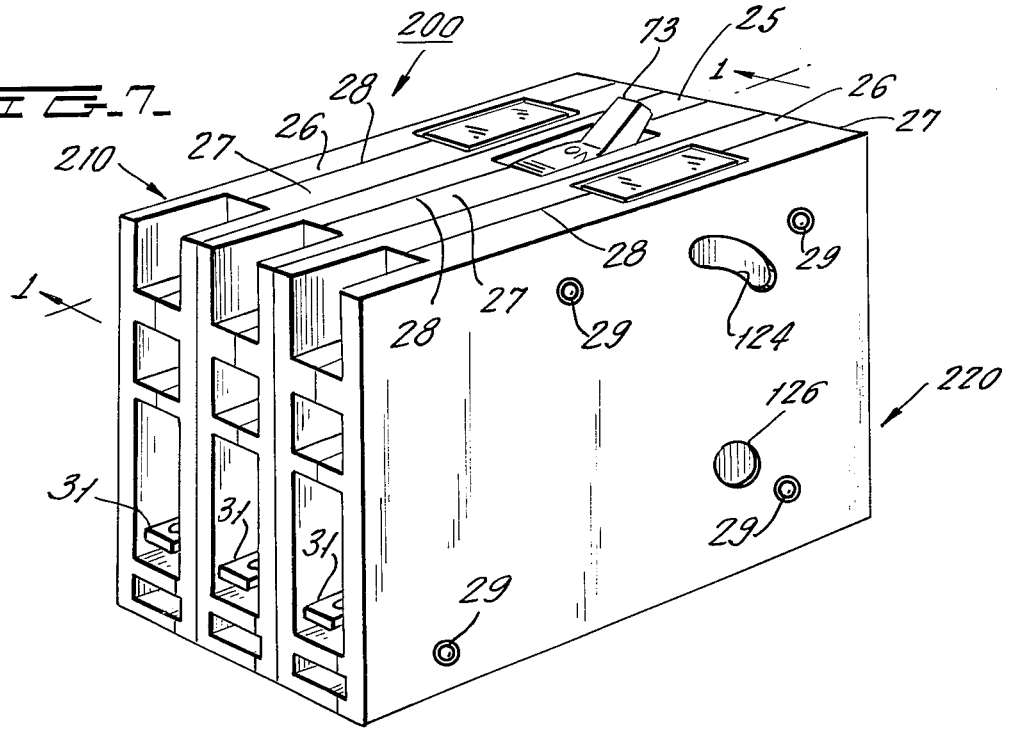
FIG. 7 is a perspective of a three pole circuit interrupter constructed in accordance with teachings of the instant invention.
Figure 3:
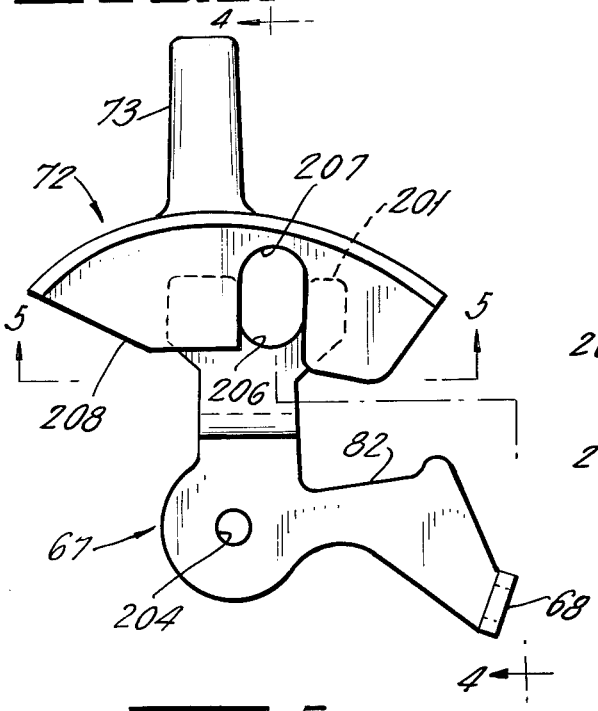
FIG. 3 is a side elevation of the cap-handle member mounted to the operating member.
Figure 4:
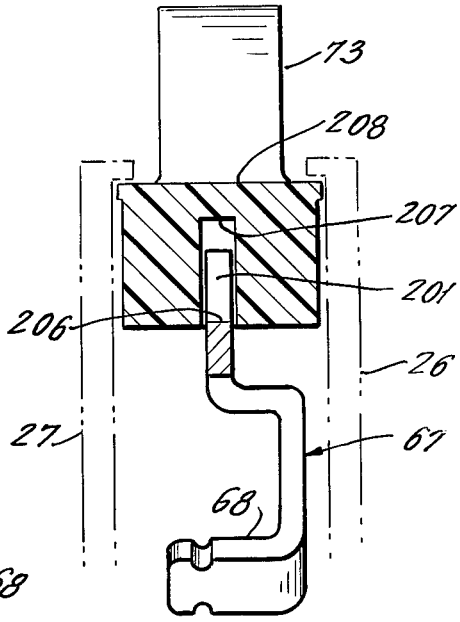
FIG. 4 is a partial cross-section taken through line 4—4 of FIG. 3 looking in the direction of arrows 4—4.

When, as shown in FIG. 7, module 25 is secured by at least two of the rivets 29. In stacked side-by-side relationship between single pole modules 210, 220, tripping of module 25 is such that automatic tripping of one of these modules will cause all of the other modules to trip, flat transverse insulating bar 120 (FIG. 1) is provided. The latter extends through a complementary aperture in trip member 105 for each of the modules 25, 210, 220. When an abnormal current condition causes automatic tripping of a pole, cradle 50 thereof is released and moves clockwise so that section 121 thereof moves downward and engages trip lever 105 pivoting the latter counterclockwise to move trip bar 120 downward. This causes the latter to engage the trip members 76 in all modules 25, 210, 220 to move these trip members counterclockwise thereby releasing the trip latches 64 in each of the non-faulted poles open substantially at the same time the faulted pole opens. Aligned, circular frangible sections 126, in the sides of housing 26, 27, when broken away provide clearance aperatures for interpole trip bar 120. Similarly, the sides of housing 26, 27 are also provided with aligned arcuate frangible sections 124 which, when removed, provide clearance for movement of transverse insulating tie rod 123. The latter extends through the aperture provided by slot 206 open at the front of operating member 67 and by the aperture provided by slot 207 open at the rear of the cap portion 202. The cooperation between slots 206, 207 forms a substantially circular aperture for tie rod 123.

Each of the outer modules 210, 220 is virtually identical to module 25 except that inplace of cap-handle member 72 each module 210, 220 is provided with an insulating cap 215 and an insulating cover 225. Cap 215 is substantially the same shape as cap portion 208 and is interengaged with the upper end 201 of an operating member 67 in the respective modules 215, 225 so as to move in unison therewith. Cover 225 is fixedly held in housing aperture 74 to close the latter. The arcuate rear surface 226 of cover 225 confronts the arcuate front surface 216 of cap 215 in very closely spaced relationship, and the flat forward surface 227 of cover 225 is approximately in the plane of the forward edge of housing 26, 27.

Thus, it is seen that transverse tie rod 123 is in operative engagement with operating members 67 of all three modules 25, 210, 220 so that the contact operating mechanisms of all modules 25, 210, 220 operate in unison even though only the single module 25 includes a manual operating handle 73. Further, tie rod 123 is concealed within the module housings 26, 27.

Although a preferred embodiment of this invention has been described, many variations and modifications will now be apparent to those skilled in the art, and it is therefore preferred that the instant invention be limited not by the specific disclosure herein but only by the appended claims.

What is claimed is:

1. A multipole circuit interrupter comprising a plurality of narrow single pole modules stacked side-by-side; each of said modules including cooperating contact means, a spring powered operating mechanism for opening and closing said contact means, trip means responsive to fault current conditions to trip the operating mechanism thereby opening said contact means, a relatively flat insulating housing wherein said contact means, said operating mechanism and said trip means are disposed; said housing including a front edge having an aperture; said operating mechanism including a movably mounted operating member; a first of said modules also including an insulating cap-handle means including a cap portion disposed within said housing and mounted to the operating member of the first module and a handle extending forward from said cap portion through said aperture of the first module to be manually engaged outside of said housing; a second of said plurality of modules including a movable cap means disposed within said housing and mounted to the operating member of said second module, and a stationary cover means for the aperture of said second module; transverse rod means positioned to the rear of said front edge extending through side aperture means in said housings, and being in operative engagement with the operating members of said first and second modules whereby the operating members thereof are connected for movement in unison.

2. A multipole circuit interrupter as set forth in claim 1 wherein operative engagement between said operating members and said rod means is achieved by providing each of said operating members with a side aperture through which said rod means extends.

3. A multipole circuit interrupter as set forth in claim 2 wherein the cap portion and the cap means are each provided with side apertures through which said rod means extends.

4. A multipole circuit interrupter as set forth in claim 3 in which the side apertures of the operating members are elongated and are open at the front thereof.

5. A multipole circuit interrupter as set forth in claim 4 in which the side apertures of the cap portion and the cap means are elongated and are open at the rear thereof.

6. A multipole circuit interrupter as set forth in claim 1 in which operative engagement between the cap portion and the operating member of the first module is achieved by providing the cap portion with recess means open at the rear of the cap portion which receives a front portion of the first module operating member; and operative engagement between the operating member of the second module is achieved by providing the cap means with recess means open at the rear of the cap means which receives a front portion of the second module operating member.

7. A multipole circuit interrupter as set forth in claim 6 wherein operative engagement between said operating member and said rod means is achieved by providing the front portion of each of said operating means with a side aperture through which said rod means extends.

8. A multipole circuit interrupter as set forth in claim 7 wherein the cap portion and the cap means are each provided with side apertures through which said rod means extends; said side apertures of each of said front portions being elongated and being open at the front thereof.

9. A multipole circuit interrupter as set forth in claim 6 in which the front portion of the first module is generally parallel to the walls of the first module housing and is disposed generally midway therebetween, and the front portion of the second module is generally parallel to the walls of the second module housing and is disposed generally midway therebetween.

10. A multipole circuit interrupter as set forth in claim 1 in which a third module of said plurality of modules is substantially of the same construction as the second module and the rod means is operatively engaged with the operating member of said third module whereby the operating members of the first, second and third modules are connected for movement in unison.

* * * * *